United States Patent [19]

Pierce

[11] Patent Number: 4,512,737

[45] Date of Patent: Apr. 23, 1985

[54] HOT ZONE ARRANGEMENT FOR USE IN A VACUUM FURNACE

[75] Inventor: Clifford R. Pierce, Perkasie, Pa.

[73] Assignee: Vacuum Furnace Systems Corporation, Souderton, Pa.

[21] Appl. No.: 496,970

[22] Filed: May 23, 1983

[51] Int. Cl.[3] ..... F27B 5/04

[52] U.S. Cl. ..... 432/205; 432/194; 373/77

[58] Field of Search ..... 432/205, 208, 144, 145, 432/148, 152, 175, 176, 193, 194; 373/77

[56] References Cited

U.S. PATENT DOCUMENTS

| | | | |
|---|---|---|---|
| 3,565,410 | 2/1971 | Scherff | 432/205 |
| 4,212,633 | 7/1980 | Koieder et al. | 432/194 |
| 4,280,807 | 7/1981 | Smith, Jr. et al. | 432/205 |
| 4,325,694 | 4/1982 | Bergman | 432/205 |

*Primary Examiner*—Henry C. Yuen

*Attorney, Agent, or Firm*—William E. Cleaver

[57] ABSTRACT

The present invention includes a heat insulation wall which is formed in a closed plane configuration, such as a circle, and which has first and second pairs of apertures formed therein to accommodate cooling (inert) gases which are introduced into the heat chamber defined by said insulation wall. The cooling gases pass into the heat chamber and out of the heat chamber through the first and second pairs of apertures to cool a workpiece which has been heat treated. The pairs of apertures lie (in pairs) opposite one another on the periphery of the heat insulation wall. Outside of the heat insulation wall, lying opposite the first pair of apertures, is located a heat reflecting member and opposite the second pair of apertures, outside of the heat insulation wall, there is located a heat reflecting baffle. Accordingly when the heat chamber is operating in a heat treating mode any heat which passes through an aperture or a pair of apertures is reflected back through said apertures into the heat chamber. The baffle is located within an exit channel housing which is formed to fit over the second pair of apertures. The exit channel housing has an opening lying on the side of the baffle away from the insulation wall or away from the second pair of apertures. Mounted on that opening is an exahust fan which when operative draws gases from the heat chamber. Accordingly when the system is in a quenching, or cooling mode, inert gases are drawn through the first pair of apertures (which are located in the bottom of the heat insulation wall), through said heat chamber to come in contact with the workpiece and effect a cooling thereof, through the second pair of apertures, around the baffle and out of the opening into the exhaust fan.

3 Claims, 2 Drawing Figures

HOT ZONE ARRANGEMENT FOR USE IN A VACUUM FURNACE

BACKGROUND

Figure 1:
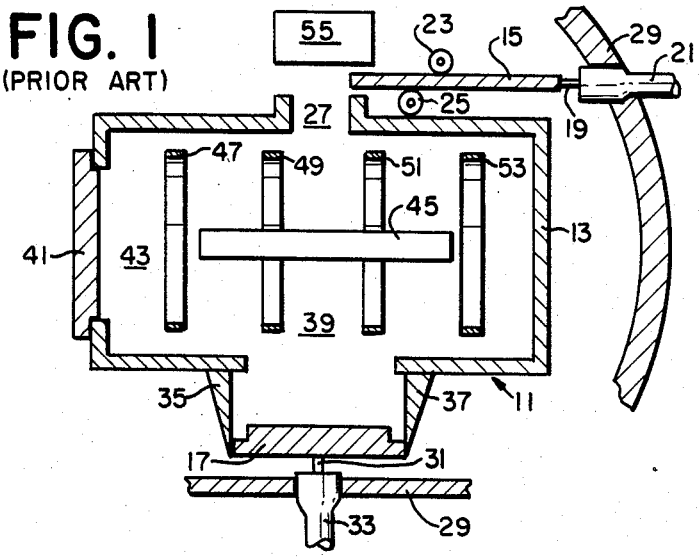
FIG. 1 (PRIOR ART)

In the vacuum furnace art a workpiece is held within a heating element to receive heat therefrom for whatever purposes the workpiece is being heat treated, such as being sintered. It has been traditional in vacuum furnaces to hold the heat generated by the heat element within the heat chamber by virtue of a heat insulation wall. It has also been recognized in the prior art that when a workpiece has been heat treated and quenching, or cooling, is necessary, it behooves the system to provide a substantial amount of cooling gases rapidly to effect the cooling or quenching. In the prior art, the quenching has been accomplished by building the heat insulation wall with at least two removable sections. One such section is located at the bottom of the heat insulation wall and the other section is located at the top of the heat insulation wall. When quenching is to take place, the removable sections of the heat insulation wall are moved downward or sideways and inert gas is pumped into and through the heat chamber with such inert gases passing through the openings left by the removed wall sections. Such removable wall sections have very often been attached to a hydraulic device, or some other mechanically movable device, which acts to move a removable section of the wall to a new location within the vacuum furnace housing.

Such a prior art system has infirmities. In such prior art systems the hydraulic devices are mounted in the side wall of the vacuum furnace housing with one part of the hydraulic device being located inside of the vacuum furnace housing and the other part of the hydraulic device being located outside of the vacuum furnace housing. Therefore such a hydraulic device must be sealed to keep the ambient atmosphere from entering into the vacuum furnace chamber. It can be readily understood that if such a seal breaks the workpiece becomes oxidized and great damage can be done to the side walls of the vacuum furnace. Secondly such hydraulic devices, or mechanical devices (as do any mechanical systems), often fail with use because of normal wear. Thirdly the quenching operation in such a prior art system is relatively time consuming because of the time required to move the removable sections of the heat insulation wall. The present invention involves no moving parts and involves no parts which require a sealing technique to permit a member to be located part way in and part way out of a vacuum furnace housing. Yet the present invention provides a means for retaining the heat generated by the heating element within the heat chamber and permits rapid quenching of the workpiece.

SUMMARY

The present invention, in a preferred embodiment, involves having a heat insulation wall means designed to encompass a heating element in a vacuum furnace. The heat insulation wall and heating element, in the preferred embodiment, are of a substantial tubular configuration. At the bottom of the heat insulation wall there is formed a pair of apertures which act for a two-fold purpose. Such apertures permit cooling gas to enter the heat chamber, during a cooling operation, and also permit heat to be reflected through such apertures, from a heat reflecting surface, to contain the heat within the heat chamber. The present system provides a heat reflecting surface member located outside of the lower apertures so that when heat passes through the lower apertures, it is reflected back into the heat chamber. At the upper section of the heat insulation wall there is formed a pair of apertures which act for a two-fold purpose. When the system is operating in a quenching mode inert gases which have passed through the heat chamber and in contact with the workpiece pass through the upper apertures to be exhausted. The upper apertures also act to permit heat which leaves the heat chamber to be reflected from a heat reflecting surface back into the heat chamber thus retaining the heat within the heat chamber. The system provides a heat reflecting baffle to work in cooperation with the upper apertures to reflect heat back into the heat chamber. A channel, or conduit, forming means is fitted over said baffle and over the upper apertures. The channel forming means has an opening therein over which there is located an exhaust fan. Gases are pulled by the exhaust fan through the lower apertures, through the heat chamber, to come in contact with the workpiece, through the upper apertures, around the baffle and are exhausted out. In accordance with the present design, heat is contained in the heat chamber and yet the heat chamber is readily filled with cooling gas during a quenching operation.

Figure 2:
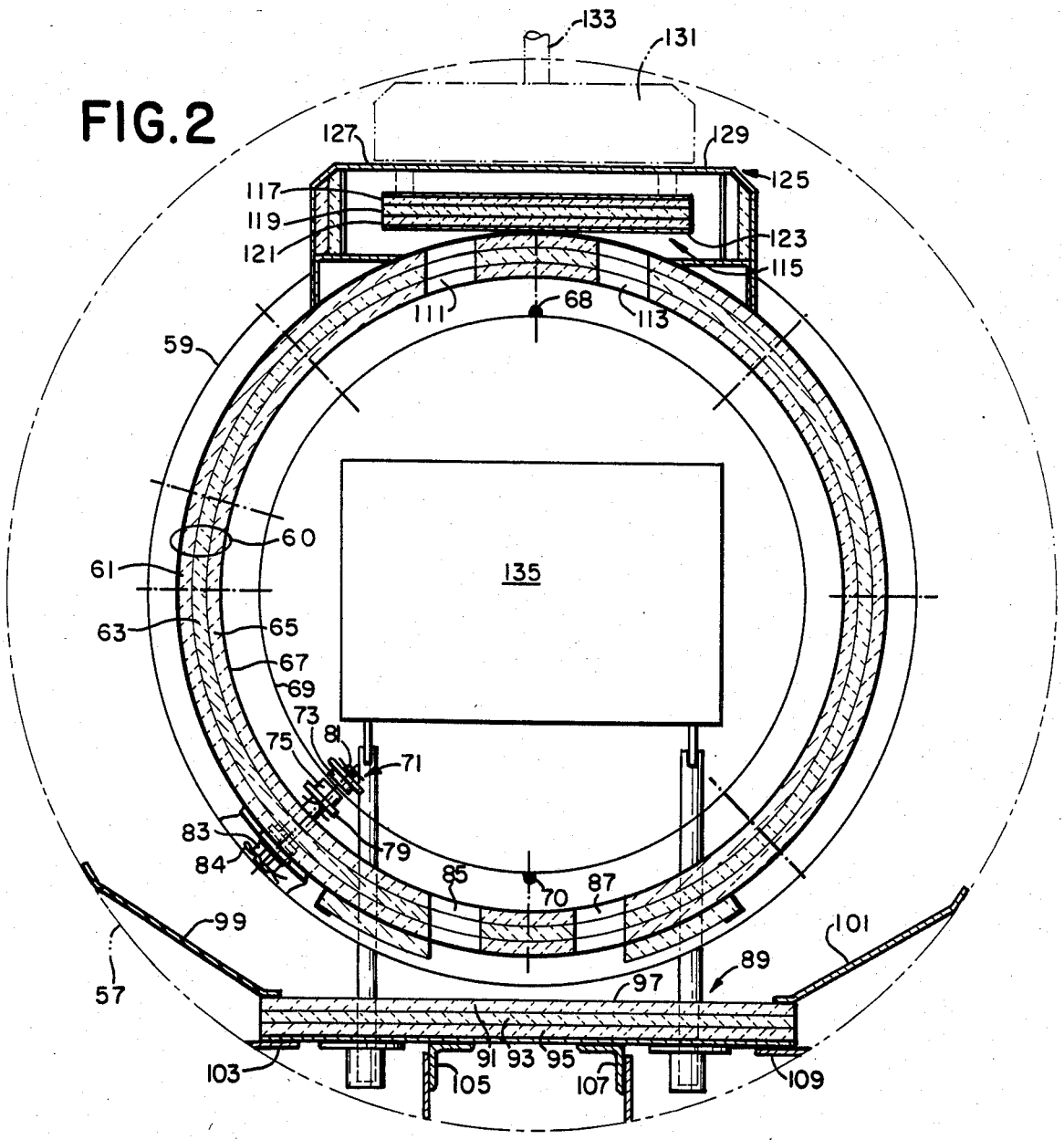

The features and objects of the present invention will be better understood in accordance with the following description taken in conjunction with the drawings wherein:

FIG. 1 is a pictorial schematic of a prior art hot zone arrangement with removable wall sections; and FIG. 2 is a pictorial schematic of the present invention.

Consider FIG. 1. In FIG. 1 there is shown a prior art hot zone chamber 11. The hot zone chamber 11 is made up of an insulation wall 13 which includes two removable sections 15 and 17. The removable wall section 15 is connected to a shaft 19 which is removably coupled to an hydraulic cylinder 21. When the hydraulic cylinder 21 is activated, by means not shown, to drive the movable wall section 15 to the left, the movable wall section 15 moves between the idler rollers 23 and 25 until it comes into the position where it closes, or caps, the opening 27. It should be noted that the hydraulic cylinder 21 is located in the wall 29 of the vacuum furnace housing. The wall 29 is shown in two sections in order the simplify the drawing. When the hydraulic cylinder 21 is located in the wall 29 a seal is employed at the edges where the hydraulic cylinder meets the wall 29 in order that the ambient atmosphere cannot leak through the hole in the wall into the hot zone chamber which sits within the vacuum furnace housing.

The other removable wall section 17 is connected to a shaft 31 which in turn is coupled to a hydraulic cylinder 33. When the hydraulic cylinder 33 is activated, by means not shown, the shaft 31 pushes the removable wall section to slide between the two guides 35 and 37 whereby it eventually closes the opening 39. The other opening into the hot zone chamber is shown on the left hand side of the drawing, whereat there is depicted a section 41 of the door. The section 41 is shown positioned to close the opening 43. Actually the section 41 is part of a much larger mechanism which includes a door that is part of the vacuum furnace housing. When the vacuum furnace housing door is swung open, the section 41 goes along with that door and accordingly the user can insert a workpiece into the hot zone chamber through the opening 43, or remove a workpiece therefrom, as the case may be.

In FIG. 1 there is shown a workpiece 45 which is surrounded to a great extent by four heating elements 47, 49, 51 and 53. The heating elements are shown as being cut through and only the cross sections of the ends are seen in FIG. 1 to simplify the drawing. It should be understood that they are bulbous in configuration and pass into the drawing and out of the drawing with the axis of the loop part of the configuration being parallel to the length of the workpiece 45.

When the prior art device, shown in FIG. 1, is in the heating mode the removable wall pieces 15 and 17 were moved into the positions whereby they respectively close the openings 27 and 39. Accordingly when the heating elements 47, 49, 51 and 53 generate heat, that heat is radiated to the workpiece 45 and both the heating elements and the workpiece radiate heat in other directions. The insulation wall retains that heat within the heat chamber to provide heat treatment of the workpiece 45. When the prior art system is used in a quenching, or cooling, mode the removable wall sections 15 and 17 are moved to the positions shown in FIG. 1. Thereafter inert gasses are introduced into the vacuum furnace housing in the vicinity of the fan 55 which drives the inert gas through the opening 27 between the heating elements 47, 49, 51 and 53 to come in contact with the workpiece 45, through the heating elements 47, 49, 51 and 53 on the lower side, out the opening 39 to an exhaust pump not shown. While the structure shown in FIG. 1 has operated reasonably well, there have been some serious infirmities such as: leaks in the seals where the pneumatic pistons are sealed into the vacuum furnace wall; break downs in the mechanical moving devices from wear and from the extreme expansion and contraction cycles in which those devices are subjected; and of course the substantial time that it takes to effect a cooling operation because of the necessity to remove the walls.

In the present invention, which is depicted in FIG. 2, there are no movable parts and virtually no sealing of elements in the wall of the vacuum furnace and yet there is provided a means which permits the heat chamber to retain its heat and at the same time permits that chamber to be readily flushed with cooling gas. In FIG. 2 there is shown a vacuum furnace wall 57. Within the vacuum furnace there is shown a hot zone chamber which is composed of an outside flange 59, an insulation wall 60, made up of three layers of graphite 61, 63 and 65 and an inside layer of graphoil 67. In a preferred embodiment the insulation wall 60 is of a circular configuration as can be seen in FIG. 2. Within the insulation wall 60 there are several heating elements one of which is shown in FIG. 2 and identified as 69. The heating element 69 has two electrical terminals, 68 and 70, which are adapted to be connected to a source of electrical current. The heating element and the insulation wall are coupled to the ring 62 by the bracket mechanism 71 which is the subject of my U.S. Pat. No. 4,259,538. In short the bracket 71 holds the heating element 69 between two insulating waffers 73 and 75 which are shielded by two graphite shields 77 and 79. There is a molybdenum rod passing through the entire assembly which is fastened by a cotter pin 81 and is drawn up by a nut 83 to the ring 62. As can be seen in the drawing there is a further cotter pin 84 through the molybdenum shaft to hold the nut 83 in position. It should be understood that there are a number of such bracket assemblies holding the heating element 69 which are not shown in order to simplify the drawing.

As can be seen in FIG. 2 there are two apertures 85 and 87 shown cut through the insulation wall. While two apertures are shown as part of the preferred embodiment, one aperture will work and such an arrangement is within the spirit of the present invention. The same would be true with respect to apertures 111 and 113 to be described below. Lying opposite the apertures 85 and 87 is a heat reflecting member 89 which is composed of three layers of graphite 91, 93 and 95 and an outer layer of graphoil 97. The makeup of the reflecting member is the same as the makeup of the heat insulating wall. The reflecting member 89 is secured in position by the brackets 99 and 101 as well as the brackets 103, 105, 107 and 109.

Also as can be seen in FIG. 2 in the upper part of the insulating wall 60 there are two other apertures formed, i.e. apertures 111 and 113. Lying opposite the apertures 111 and 113 is the heat reflecting baffle 115 which is made up of three layers of graphite 117, 119 and 121 as well as a layer of graphoil 123. Mounted over the baffle 115 and over the apertures 111 and 113 is a channel forming cap 125. In the uppermost end of the channel forming cap 125 there is formed an opening which is identified by the edges 127 and 129. The opening which is identified by the edges 127 and 129 opens into the exhaust fan 131 which is coupled to an exhaust tube 133 so that when the exhaust fan pulls or draws gasses from the hot zone chamber, the gasses are passed through the tube 133 outside the vacuum furnace wall to a heat exchanger to be returned to the system thereafter. As can be further gleaned in FIG. 2 within the heat chamber and in particular within the heating elements, there is located a workpiece 135.

When the system shown in FIG. 2 is in the heat treating mode of operation, the heating element 69 and the others, which are not shown in FIG. 2, are subjected to having electrical current pass therethrough to generate heat. The heat generated by the heating elements is radiated to the workpiece 135 and in other directions as well. The heat is retained by the heat insulation wall and the heat that radiates back from the workpiece is also retained by the heat insulation wall. Indeed part of the heat radiated from the workpiece and from the heating elements passes through the apertures 85 and 87. However, when that heat strikes the reflecting surface 97 of the heat reflecting member that heat is largely reflected back into the hot zone chamber thereby eliminating any possibility of cold spots, or heat sinks, in the lower portion of the hot zone chamber. In a like manner heat is transmitted through the apertures 111 and 113 but when that heat strikes the heat reflecting surface 123, of the heat reflecting baffle 115, and heat reflecting surface 124 of channel forming cap 125 that heat is reflected back into the hot zone chamber to eliminate the possibilities of a cold spot, or heat sink, at the upper portion of the hot zone chamber. When the system shown in FIG. 2 is to operate in the quenching mode, or the cooling mode, inert gasses are introduced into the vacuum furnace housing, through a means not shown, and simultaneously therewith the fan 131 is activated to operate and draw the inert gasses through the apertures 85 and 87 into the hot zone chamber. The inert gasses passing through the apertures 85 and 87 continue and pass through the slots between the heating elements and come in contact with the workpiece 135 thereby cooling that workpiece. The inert gasses continue to be drawn toward the exhaust fan 131 through the apertures 111 and 113. When the gasses pass through the apertures 111 and 113 they are forced to pass around the baffle 115 and through the opening defined by the edges 127, 129 into the exhaust fan 131 and out through the tube 133.

The present system recognizes and accommodates two major requisites for the vacuum furnace system. In the first place the present system recognizes the necessity to retain heat within the heat chamber without creating cold spots, or heat sinks, which in themselves create a distorted heat treatment of the workpiece. Secondly the system recognizes that when a quenching operation is required it is necessary to provide a substantial amount of cooling gas, or inert gas, into the hot zone chamber and readily have that gas pass over the workpiece to effect the cooling. The system shown in FIG. 2 does not require any large scale devices to be located within the vacuum furnace wall and therefore eliminates any necessity to seal large devices as was true in the prior art system. The present system shown in FIG. 2 does not require any movable parts. The baffle is stationary as is the heat reflecting member in the lower portion in the system. Hence there is no breakdown of mechanical moving parts through wear or in response to the extremities of contraction and expansion as is true in the prior art system. Thirdly the present system does not require any additional time, during a quenching operation, to remove two sections of the wall and hence when a workpiece has been heat treated and there is quenching required this can be accomplished very readily and indeed in a far faster time than was true in the prior art system. It follows without a great deal of discussion that the present system is more economical because there is no necessity to have hydraulic systems moving movable sections of the wall and such hydraulic systems are costly.

I claim:

1. A hot zone arrangement for use in a vacuum furnace, wherein said vacuum furnace has a housing and a means for selectively introducing cooling gas to effect cooling of a workpiece, comprising in combination: circular heating element means formed to have an external boundary and adapted to have electrical energy supplied thereto to generate heat; circular hot zone means having upper and lower sections and heat insulation means, said circular hot zone means disposed to substantially encircle said external boundary of said circular heating element means, thereby holding heat, generated by said heating element means, within said hot zone means; said hot zone means formed to have first and second aperture means in the periphery of said upper section and third and fourth aperture means in the periphery of said lower section; heat reflecting means disposed to lie outside said hot zone means and disposed to lie in close proximity to a tangent point of the circular hot zone, which tangent point is between said third and fourth aperture means such that heat passing from said hot zone means through said third and fourth aperture means is largely reflected back into said hot zone means through said third and fourth aperture means; heat reflecting baffle means disposed to lie outside said hot zone means and in close proximity to a tangent point of the circular hot zone means, which tangent point is between said first and second aperture means such that heat passing from said hot zone means through said first and second aperture means is largely reflected back into said hot zone means through said first and second aperture means; channel forming means formed to have heat reflecting internal surfaces and formed to fit over said heat reflecting baffle means and over said first and second aperture means such that heat which is not reflected into said hot zone means by said heat reflecting baffle means will be reflected through said first and second aperture means by said heat reflecting internal surfaces, said channel forming means further formed to have an exit aperture therein disposed such that said heat reflecting baffle means is intermittent between said exit aperture and said first and second aperture means whereby cooling gas passing through said hot zone means and through said first and second aperture means will flow through said channel forming means, around said baffle means, out said exit aperture; gas drawing means formed and disposed to draw gas through said exit aperture whereby when a workspace is to be cooled, cooling gas is introduced into said vacuum furnace housing and passes through said third and fourth aperture means, passes through said hot zone means, comes in contact with said workpiece, passes through said first and second apertures, around said baffle means and into said gas drawing means.

2. A hot zone arrangement according to claim 1 wherein said heat reflecting means is formed of a plurality of layers of graphite and one layer of graphoil and wherein said layer of graphoil faces said third and fourth aperture means to provide a heat reflecting surface therefor.

3. A hot zone arrangement according to claim 1 wherein said baffle means is formed of a plurality of layers of graphite and one layer of graphoil and wherein said layer of graphoil faces said first and second aperture means to provide a heat reflecting surface therefor.

* * * * *